United States Patent [19]

Siciliano

[11] Patent Number: 4,557,426

[45] Date of Patent: Dec. 10, 1985

[54] DISPENSER FOR TOILET PAPER AND THE LIKE

[76] Inventor: Stephen J. Siciliano, 1701 NW. 2nd St., Deerfield Beach, Fla. 33441

[21] Appl. No.: 625,687

[22] Filed: Jun. 28, 1984

[51] Int. Cl.[4] ..... B65H 19/04

[52] U.S. Cl. ..... 242/55.3; 242/55.53; 225/34

[58] Field of Search ..... 242/55.3, 55.53, 55.54, 242/55.42; 312/38, 39, 40, 41; 225/34, 47

[56] References Cited

U.S. PATENT DOCUMENTS

| | | | |
|---|---|---|---|
| 2,512,200 | 6/1950 | Duncan | 242/55.3 |
| 2,535,621 | 12/1950 | Andrews | 242/55.3 |
| 2,840,319 | 6/1958 | Danko | 242/55.3 |
| 3,151,551 | 10/1964 | Dutro et al. | 242/55.2 X |
| 3,335,973 | 8/1967 | Genn | 242/55.53 |
| 3,475,067 | 10/1969 | Girard | 312/39 |
| 3,552,669 | 1/1971 | Earnest | 242/55.3 |
| 3,622,096 | 11/1971 | Young | 242/56.9 |

*Primary Examiner*—Leonard D. Christian

*Attorney, Agent, or Firm*—Eugene F. Malin

[57] ABSTRACT

Disclosed is an especially convenient system for dispensing rolled sheet material such as toilet paper or the like. The system has a vertically mounted rotary member disposed for rotation about a horizontal axis with several vertically disposed cantilevered spools for supporting sheet material.

The rotary member is preferably mounted within a vanity cabinet adjacent a toilet seat, with an opening cut in the cabinet wall at the place on which a roll of toilet paper would ordinarily be mounted. A plurality of toilet paper rolls can be placed upon a plurality of spools, and the rotary member rotated to bring a roll within the opening for ready access by a user. There is a bracket on the cabinet adjacent the opening, and an elongate keylock that slides through the bracket and into the roll and spool within the opening, to lock the roll against axial displacement along the spool. When one roll is exhausted, another is had by rotating the rotary member until another roll enters the cabinet opening.

3 Claims, 7 Drawing Figures

DISPENSER FOR TOILET PAPER AND THE LIKE

BACKGROUND

This invention pertains broadly to dispensers of rolled sheet material. Such dispensers have a plurality of spools for receiving a plurality of such rolls, the rolls typically being consumed one after another. The invention is particularly useful as a dispenser of toilet paper in bathrooms having vanity cabinets adjacent toilets, such as are common in many condominium and apartment units.

Running short of toilet paper is a hazard that is always aggravating and occasionally embarassing. Conventional dispensers for plural toilet paper rolls are unduly expensive and difficult to operate, and generally do not provide the convenience necessary to penetrate the home, as well as the commerical, market.

SUMMARY OF THE INVENTION

Accordingly, it is an object of this invention to provide a dispenser for plural rolls of sheet material, such as toilet paper, that can hold a large number of such rolls.

It is a further object of this invention to provide such a dispenser that has few moving parts and is simple to operate.

It is a further object of this invention to provide such a dispenser that is easily and manually operated.

It is a further object of this invention to provide such a dispenser that is inexpensive to own and easy to manufacture.

In accordance with these and other objects that shall become apparent hereinafter, there is provided a system for dispensing such rolled sheet material having a vertically mounted rotary member disposed for rotation about a horizontal axis, with several vertically disposed cantilevered spools for supporting the rolls of sheet material. Each cantilevered spool can receive one roll of toilet paper and is provided with a means for locking the toilet paper in place for rotation about the spool. The rotary member is preferrably star shaped with one such spool located at each point of the star shape.

The rotary member is preferably located within a vanity cabinet adjacent a toilet seat, the cabinet having an opening cut at the place in which would normally be mounted a conventional bracket for holding a roll of toilet paper. The rotary member is preferrably mounted by a flange attached to the top of the cabinet, and so disposed that each roll of toilet paper at each point of the star can be rotated into and out of the hole in the cabinet wall for ready access by a user. When the roll of toilet paper is exhausted, the other rolls are had sequentially by rotating the rotary member until the next roll is within the opening in the cabinet wall.

The rotary member is mounted for rotation to the mounting flange. There can be a simple bearing structure, for example, a ball and ball race between the flange and rotary member, but in the preferred embodiment there is no intermediate bearing structure. The overall result is a dispensing system that is especially simple mechanically, and is especially reliable and inexpensive.

The instant invention will be more fully understood from the following detailed description, it being understood, however, that the invention is capable of extended application and is not confined to precise disclosure. Changes and modification may be made that do not affect the spirit of invention nor exceed the scope thereof, as expressed in the appended claims. Accordingly, the invention will now be described with reference to the accompanying drawings.

BRIEF DESCRIPTION

DETAILED DESCRIPTION

Figure 1:
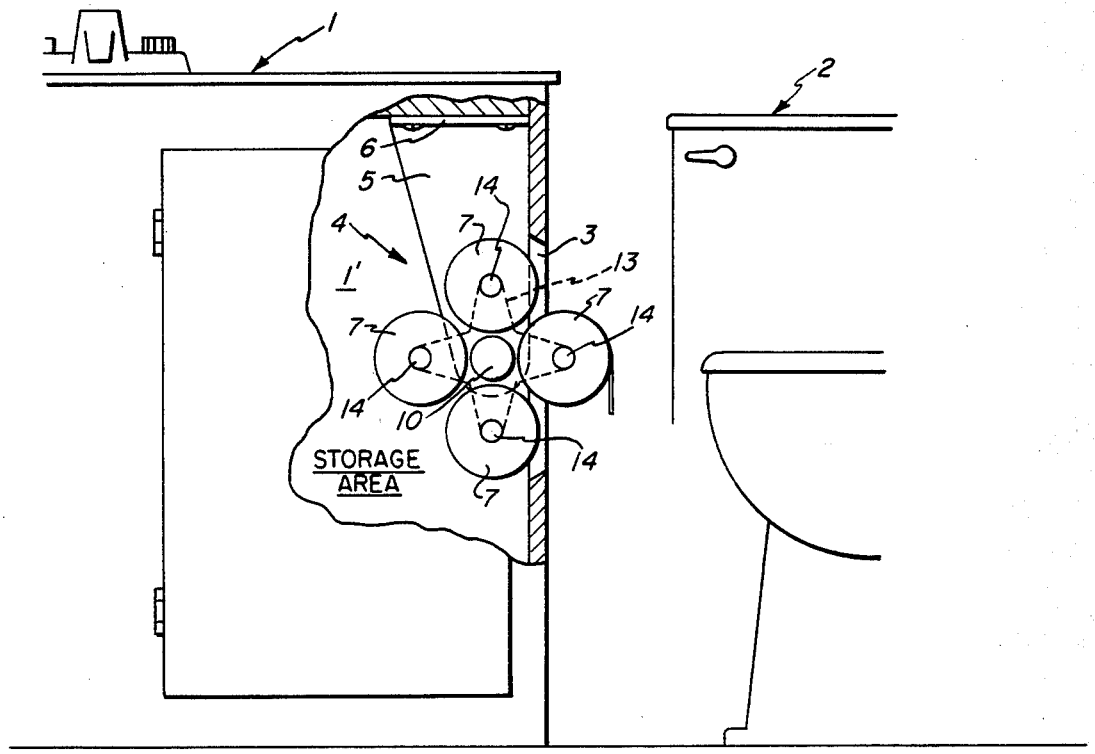
FIG. 1 is a plan view showing the instant invention in use in a vanity of a typical residential bathroom.

With particular reference to the drawing figures, and especially FIG. 1, there is shown a residential type bathroom having a vanity cabinet 1 with an interior 1', and a toilet 2. Witin interior 1' of cabinet 1 is a toilet paper dispenser 4 supported by flange 5, which, in the embodiment shown is attached to the top of cabinet 1 by a mounting means 6. The mounting means can be any appropriate or conventional bracket, adhesive, or any other appropriate means. Top mounting of dispenser 4 is not critical to applicant's inventive concept. Dispenser 4 could be mounted to, e.g., a side, the back, of the bottom of cabinet 1. Attached to flange 5 for rotation about a horizontal axis is rotary member 12 (best seen FIG. 2). The rotary member carries a plurality of toilet paper rolls in a manner to be described below. Flange 5 and rotary member 12 are each disposed with respect to opening 3 in cabinet 1 so that rotation of rotary member 12 about its horizontal axis (which passes through 10) sequentially brings each roll 7 of toilet paper into opening 3 for ready access to a user located generally at toilet 2 or in the vincity of cabinet 1.

Figure 2:
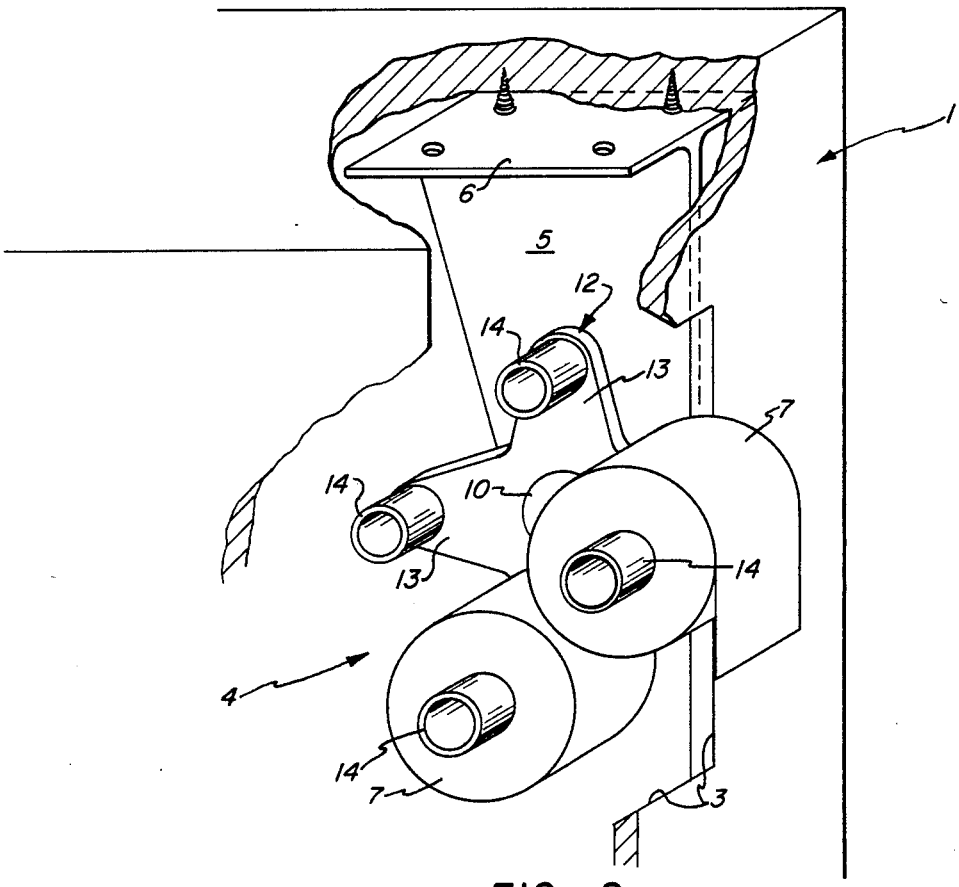
FIG. 2 is an elevational view showing the instant invention mounted within the vanity cabinet. Part of the cabinet is broken away to better illustrate the invention.

With particular reference to FIG. 2, rotary member 12 is seen to be generally star shaped, with a plurality of spools 14 located cantileveredly at each point of the star shape. Rotary member 12 rotates about a horizontal axis that passes through hub 10, hub 10 being described in more detail below. Each spool 14 is adapted to rotate about its cylindrical axis with respect to rotary member 12 in a known manner, which makes it easier for a user to rotate member 12 about hub 10 by grasping a spool 14 and pushing it vertically. An alternative shape for rotary member 12 is circular; however, the star shape is preferred because it consumes less material in manufacturing. In FIG. 2, rotary member 12 is shown carrying two rolls 7 of toilet paper, and having two spools 14 empty, thus having a maximum capacity of four rolls. Given the size of standard toilet paper rolls and space limitations in typical residential bathrooms, four rolls is considered to be an optimal capacity for member 12 when dispenser 4 is used to carry toilet paper.

Figure 3:
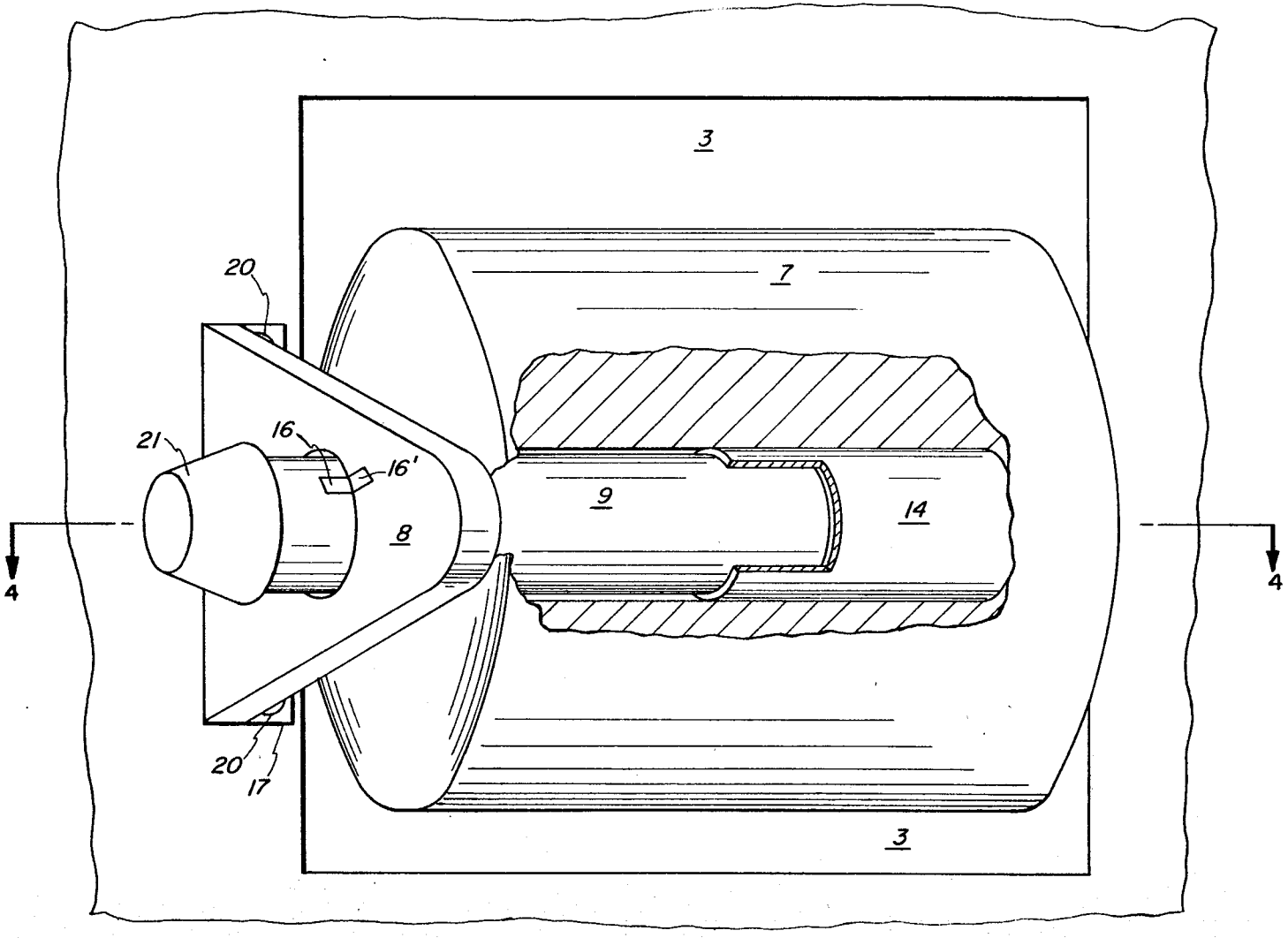
FIG. 3 is a perspective view of one roll ready for use. Parts of the roll, and the spool on which the roll rides, are broken away to better illustrate the invention.
Figure 5:
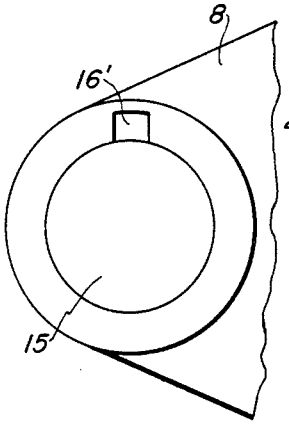
FIG. 5 is an elevational view (not in section as is FIG. 4) in the direction of lines 5—5 of FIG. 4 of the bracket that locks the roll to the vanity cabinet.
Figure 4:
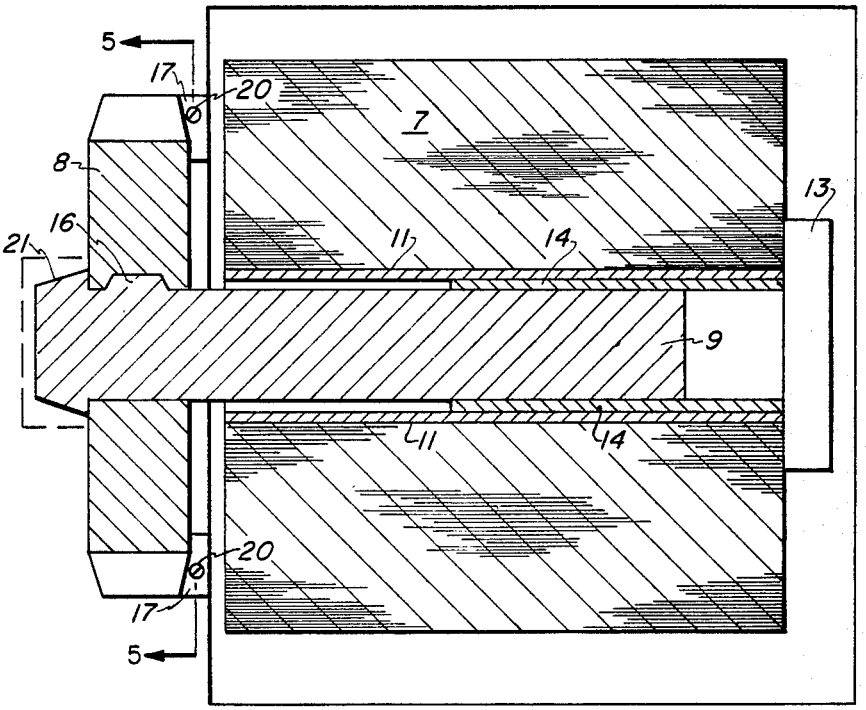
FIg. 4 is a sectional view in the direction of lines 4—4 of FIG. 3.

With particular reference to FIGS. 3 through 5, the scheme by which roll 7 of toilet paper is fixed to spool 11 is seen. In these Figures, a spool 7 is shown located within cabinet opening 3, ready for use. Again, a spool 14 extends cantileveredly from arm 13 of rotary member 12. Spool 14 is made free turning on arm 13 about its cylindrical axis, so that spool 14 can rotate with roll 7 during use. The radial diameter of spool 14 is such that inner cardboard spool 11 of roll 7 fits snugly over spool 14, but not so snugly that a user would have difficulty loading roll 7 on dispenser 4. Roll 7 is locked against axial movement by member 9, which is in the form of a cylindrical key-lock. In a preferred embodiment, bracket 8 is fixed to cabinet 1 adjacent opening 3, and has two generally perpendicular portions, a planar mounting portion 17 flush against cabinet 1 and mounted to cabinet 1 by screws 20, and a locking portion having an opening 15. Member 9 is sized to slide through opening 15, cardboard spool 11, and mounting spool 14 until the encap portion 21 of member 9 prevents further entry, and lock itself to bracket 8 by push and twist lock 16, 16'. Member 16 is a male protuberance on member 9; 16', a complimentary female opening in bracket 8 extending from opening 15. The twist and lock scheme is best seen in FIG. 5.

Figure 6:
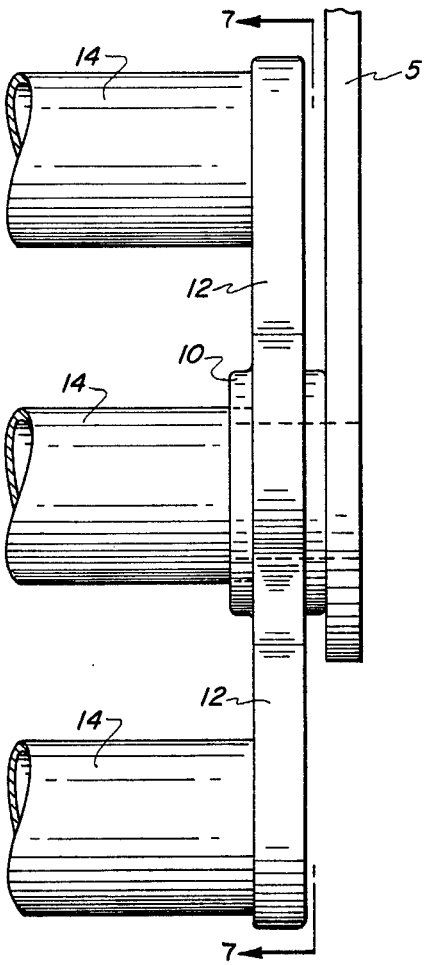
FIG. 6 is an elevational view of the mounting flange and rotary member of the instant invention with the spools of the rotational member partially cut away.
Figure 7:
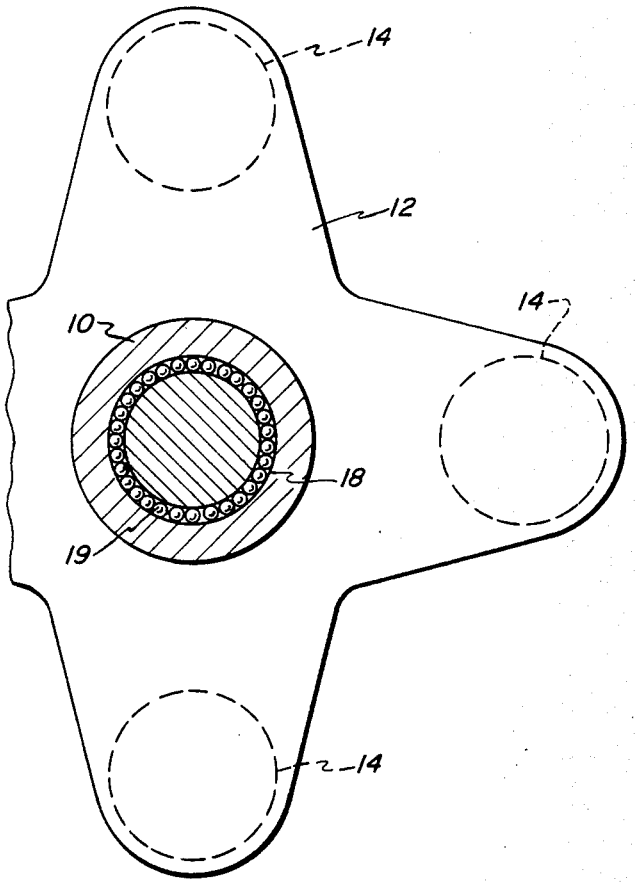
FIG. 7 is a partial sectional view in the direction of lines 7—7 of FIG. 6.

With particular reference to FIGS. 6 and 7, it is seen that rotary member 12 rotates about a point of flange 5 by means of bearing structure 10. Bearing structure 10 can be any appropriate bearing and in one embodiment is preferrably comprised of a ball and ball cup bearing structure, having ball race 18 with a plurality 19 of ball bearings. The tightness of the ball bearing packing is preferrably selected to enable convenient rotation of rotary member 12 by hand, but still withstand the maximum turning moment that a roll of toilet paper disposed at the extremity of an arm 13 could exert. However, in a preferred embodiment, any intermediate bearing structure is dispensed with, and complimentary portions of hub 10 and flange 5 bear directly on one another.

In operation as a toliet paper dispenser, a user slides a roll 7 over each spool 14, and rotates member 12 so that one spool enters opening 3. Opening 15 in bracket 8 is aligned with roll 7's cylindrical opening defined by its cardboard spool 11, cylinder key-lock 9 inserted through opening 15 and spools 11, 14, until encap 21 abuts bracket 8, and cylinder 9 locked to bracket 8 by push and twist lock 16, 16'. Upon exhaustion of roll 7, cylinder lock 9 is removed by reversing this sequence, rotary member hand-turned until a new roll 7 enters opening 3, and new roll 7 locked to bracket 8 as before.

Although the invention is here described as a dispenser of toilet paper, this is merely for illustrative purposes. It is pointed out that the scope of the invention is broader than this particular application, and that this scope is set forth in the appended claims. Indeed, the instant invention has been shown and described herein what is considered to be the most practical and preferred embodiment. It is recognized, however, that departures made be made therefrom as set forth in the claims, and that obvious modifications may occur to one skilled in this art.

It is claimed that:

1. A system for dispensing rolled sheet material, said system comprising:

a rotary member disposed for rotation about a generally horizontal axis;

a plurality of generally elongate spool means for carrying said sheet material, each of said plurality of spool means being cantileveredly attached to said rotary member and fixed to said rotary member for rotation with said rotary member about said generally horizontal axis;

wherein said system comprises a generally vertically disposed partition means, said partition means comprising an opening means, said rotary member being located, and said opening means sized, shaped, and disposed, to enable each of said plurality of spool means to be manually accessible across said partition means by rotating said rotary member about said generally horizontal axis until a selected one of said plurality of spools is within said opening means, wherein said system further comprises a means for fixing said rolled sheet material against movement along the elongate length of said spool means, said means for fixing comprising a bracket and a key lock means for aligning said bracket and said spool.

2. The system of claim 1, wherein one or more of said plurality of spool means comprises a spool opening, said key lock means is generally elongate, said bracket means is attached to said partition means adjacent said opening means, said bracket further comprising a portion extending generally perpendicularly from said partition means, said portion comprising a bracket opening, said key lock means being adapted to extend through said bracket opening and said spool opening in the one of said one or more of said plurality of spools located in said opening means to fix said rolled sheet material carried by said spool means located in said opening means against movement along the elongate length of said spool means located in said opening means.

3. The system of claim 2, wherein said key lock and said bracket together comprise a means for locking said key lock and bracket together, said means for locking comprising a male key member adapted to mate with a female opening, said means for locking constituting a push-and-twist locking means.

* * * * *

UNITED STATES PATENT AND TRADEMARK OFFICE

CERTIFICATE OF CORRECTION

PATENT NO. : 4,557,426

DATED : December 10, 1985

INVENTOR(S) : Stephen J. Siciliano

It is certified that error appears in the above-identified patent and that said Letters Patent is hereby corrected as shown below:

Column 3, line 1

Delete "11" and insert --14-- and delete "spool" and insert --roll--.

Signed and Sealed this

*Seventeenth* Day of *June 1986*

[SEAL]

*Attest:*

DONALD J. QUIGG

*Attesting Officer*

*Commissioner of Patents and Trademarks*